US010611517B2

(12) United States Patent
Clark et al.

(10) Patent No.: US 10,611,517 B2
(45) **Date of Patent: *Apr. 7, 2020**

(54) VENTILATED CONTAINER APPARATUS

(71) Applicant: Mastronardi Produce Ltd., Kingsville (CA)

(72) Inventors: Jeanne Clark, Los Angeles, CA (US); Ricardo Astorga, Whittier, CA (US)

(73) Assignee: Mastronardi Produce Ltd., Kingsville (CA)

( * ) Notice: Subject to any disclaimer, the term of this patent is extended or adjusted under 35 U.S.C. 154(b) by 80 days.

This patent is subject to a terminal disclaimer.

(21) Appl. No.: 15/913,433

(22) Filed: Mar. 6, 2018

(65) Prior Publication Data

US 2018/0194516 A1 Jul. 12, 2018

Related U.S. Application Data

(63) Continuation of application No. 15/191,619, filed on Jun. 24, 2016, now Pat. No. 9,944,431, which is a (Continued)

(51) Int. Cl.
*B65D 81/24* (2006.01)
*B65D 21/02* (2006.01)
(Continued)

(52) U.S. Cl.
CPC ..... *B65D 21/0201* (2013.01); *B65D 25/38* (2013.01); *B65D 43/02* (2013.01);
(Continued)

(58) Field of Classification Search
CPC ..... B65D 81/263; B65D 43/162; B65D 21/0201; B65D 43/02; B65D 77/2024
See application file for complete search history.

(56) References Cited

U.S. PATENT DOCUMENTS 3,067,039 A 12/1962 Crane
3,351,270 A 11/1967 Hohnjec
(Continued)

FOREIGN PATENT DOCUMENTS

EP 0500318 A1 8/1992
FR 2941680 A1 8/2010
(Continued)

OTHER PUBLICATIONS

International Search Report and Written Opinion cited in co-pending application Serial No. PCT/US2015/036645, filed Jun. 19, 2015, 10 pages.

*Primary Examiner* — Stephen J Castellano
(74) *Attorney, Agent, or Firm* — Dinsmore & Shohl LLP

(57) ABSTRACT

A container apparatus having at least one containment member is disclosed that may include a bottom and at least one sidewall, an interior and an open end. The container may also include a flange that extends around a free end of the at least one side wall, and a plurality of wall members (or castellations) connected to/formed with/that extend from the flange. The plurality of wall members may be separated by ventilation apertures, with the plurality of wall members and the ventilation apertures extending around the perimeter of the free end. A sealing material, such as a removable film, may extend over the open end to enclose the containment member.

20 Claims, 6 Drawing Sheets

Related U.S. Application Data continuation of application No. 14/744,753, filed on Jun. 19, 2015, now Pat. No. 10,364,066.

(60) Provisional application No. 62/014,112, filed on Jun. 19, 2014.

(51) Int. Cl.

| | |
|---|---|
| ***B65D 25/38*** | (2006.01) |
| ***B65D 43/22*** | (2006.01) |
| ***B65D 77/20*** | (2006.01) |
| ***B65D 81/26*** | (2006.01) |
| ***B65D 81/32*** | (2006.01) |
| ***B65D 43/02*** | (2006.01) |
| ***B65D 43/16*** | (2006.01) |

(52) U.S. Cl.

CPC ..... *B65D 43/0204* (2013.01); *B65D 43/162* (2013.01); *B65D 43/22* (2013.01); *B65D 77/2024* (2013.01); *B65D 81/263* (2013.01); *B65D 81/3205* (2013.01); *B65D 2543/0062* (2013.01); *B65D 2543/00101* (2013.01); *B65D 2543/00296* (2013.01); *B65D 2543/00351* (2013.01); *B65D 2543/00527* (2013.01); *B65D 2543/00546* (2013.01); *B65D 2543/00574* (2013.01); *B65D 2543/00703* (2013.01); *B65D 2543/00731* (2013.01); *B65D 2543/00814* (2013.01)

(56) References Cited

U.S. PATENT DOCUMENTS

| | | | |
|---|---|---|---|
| 3,480,197 | A | 11/1969 | Massey |
| 3,482,679 | A | 12/1969 | Bixler |
| 3,565,146 | A | 2/1971 | Arnolds |
| 3,933,295 | A | 1/1976 | Congleton |
| 3,933,296 | A | 1/1976 | Ruskin et al. |
| 4,459,793 | A | 7/1984 | Zenger |
| 4,844,330 | A | 7/1989 | Roosa et al. |
| 4,951,866 | A | 8/1990 | Rusnak |
| 5,094,355 | A | 3/1992 | Clark et al. |
| 5,312,634 | A | 5/1994 | Griesbach et al. |
| 5,820,908 | A | 10/1998 | Li |
| 6,007,854 | A | 12/1999 | Cadiente et al. |
| 6,372,273 | B1 | 4/2002 | Mabry et al. |
| 6,845,878 | B2 | 1/2005 | Hayes et al. |
| D579,326 | S | 10/2008 | Chen |
| D628,472 | S | 12/2010 | Strange et al. |
| 8,261,933 | B2 | 9/2012 | Kidd et al. |
| 8,596,487 | B1 | 12/2013 | Su |
| 8,807,385 | B1 | 8/2014 | Fosse |
| 8,939,287 | B2 * | 1/2015 | Markovitch ..... A61L 2/26 206/363 |
| 9,944,431 | B2 * | 4/2018 | Clark ..... B65D 21/0201 |
| 2006/0042995 | A1 | 3/2006 | McGrath et al. |
| 2007/0172554 | A1 | 7/2007 | Blythe et al. |
| 2009/0223966 | A1 | 9/2009 | Kidd et al. |
| 2009/0242579 | A1 | 10/2009 | Huang |
| 2011/0233077 | A1 | 9/2011 | Cadiente et al. |
| 2013/0220855 | A1 | 8/2013 | Markovitch |
| 2013/0327819 | A1 | 12/2013 | Baker et al. |
| 2015/0367987 | A1 | 12/2015 | Clark et al. |

FOREIGN PATENT DOCUMENTS

| | | | |
|---|---|---|---|
| FR | 2947252 | A1 | 12/2010 |
| GB | 2295815 | A | 6/1996 |
| GB | 2334019 | A | 8/1999 |
| JP | 2001-240149 | A | 9/2001 |
| JP | 2004314982 | A | 11/2004 |
| JP | 5438357 | B2 | 3/2014 |
| WO | 2009125241 | A1 | 10/2009 |

* cited by examiner

VENTILATED CONTAINER APPARATUS

CROSS-REFERENCE TO RELATED APPLICATIONS

This application is a continuation of U.S. application Ser. No. 15/191,619 filed Jun. 24, 2016, now U.S. Pat. No. 9,944,431, which is a continuation of U.S. application Ser. No. 14/447,753 filed Jun. 19, 2015, now U.S. Pat. No. 10,364,066.

This Application claims the benefit of U.S. Non-Provisional application Ser. No. 15/191,619 filed Jun. 24, 2016, which claims the benefit of U.S. Non-Provisional application Ser. No. 14/744,753 filed Jun. 19, 2015, which claims the benefit of U.S. Provisional Application 62/014,112 filed on Jun. 19, 2014, the contents of which are incorporated by reference herein in its entirety.

TECHNICAL FIELD

A container apparatus is disclosed having at least one, or a first, container or containment member that may optionally be connected to another, or second, container or containment member via a hinge. Also disclosed is at least one, or a first, container or containment member having a predetermined number of upper wall members (or castellations) positioned about an open end of the container member with the open end being enclosed by a film.

BACKGROUND

Plastic walled containers are common household items, with a wide range of domestic and commercial uses. Such containers are, for example, often used as packaging for fresh produce, including fresh fruits (e.g., strawberries), fresh vegetables (e.g., tomatoes), other food items, and other consumable items. The containers come in a range of different shapes (e.g., cylinders, square/box, rectangular/box, etc.) and sizes. Some containers, such as those used with fresh produce, also include holes or other apertures through the container sidewall for purposes of ventilating the container interior.

One type of container may include a base having an internal cavity or containment area or space, and a lid (which may also have an internal cavity, space or area) connected to the base by a hinge. Typically, items are placed in the base and the lid is folded (via the hinge) over onto the base to secure the food items within the base. Since there may be no barrier between the internal cavity of the base and the internal cavity of the lid, items may only be placed within the internal cavity of the base. If food items were placed in the internal cavity of the lid, the food items may fall out of the lid when the lid is folded over onto the base. That is, the food items would fall out of the container or fall within the internal cavity of the base causing contamination of the food items.

Consequently, it would be desirable to have a container that permits a large storage capacity, ventilation of the internal cavit(ies) of the base, and in some embodiments prevent cross contamination of items stored in different cavities.

SUMMARY

A container apparatus is provided having at least one containment or container member. In one embodiment, a first containment member may have a bottom or floor, a pair of lower sidewalls, and a pair of lower end walls. The bottom, the pair of lower sidewalls, and the pair of lower end walls may be integrally connected so that an edge of the pair of lower sidewalls and the pair of lower end walls may extend outwardly to form a (lower) flange to hingedly connect to a second containment member. A second optional containment member may include a top, a pair of upper sidewalls, and a pair of upper end walls. Similar to the first member, the top, the pair of upper sidewalls and the pair of upper end walls of the second containment member may be integrally connected so that an edge of the pair of upper sidewalls and the pair of upper end walls may extend outwardly to form an upper flange.

In one embodiment, the flange may include a plurality of lower wall members (or castellations) that may be separated from one another by a (first) plurality lower ventilation apertures. The lower wall members may extend around the perimeter of the lower flange and may be contacted/engaged by a (first) sealing material so as to cover the opening to the first containment member. Further, the upper flange may likewise include a plurality of upper wall members, separated from each other by upper ventilation apertures, with the wall members extending around the perimeter of the upper flange and be engaged by a (second) sealing to cover the opening to the second containment member.

In some embodiments, the container may include one or more (e.g., a pair, or three, or four) locking mechanisms for securing the first containment member to the second containment member. A first locking mechanism in the pair of locking mechanisms may include a first extending latching portion located on the second containment member and shaped to be received within a first inwardly recessed pocket located on the first containment member. A second locking mechanism in the pair of locking mechanism may include a second extending latching portion located on the second containment member and shaped to be received within a second inwardly recessed pocket located on the first containment member.

In other embodiments, the container apparatus may include a first containment member having a bottom and at least one sidewall, with the bottom and the at least one sidewall being integrally connected and forming an interior space of the containment member. The container apparatus may further include a flange integrally connected to and extending around a free end/open end of the at least one side wall. A plurality of wall members (or castellations) may be connected to, or formed in or with, the flange, with the wall members being separated or spaced from one another by ventilation apertures. Moreover, the container apparatus may be enclosed (to prevent goods from falling out of the interior space) by the use of a film that covers (or optionally substantially covers) the open end and is mounted to the (top, or interior or exterior sides) of the wall members. In one embodiment, the sealing material is removably connected to the plurality of wall members. Further, in alternative embodiments, the first containment member may be connected by a hinge to a second, similarly shaped, containment member.

In yet another embodiment, the container apparatus may include a first containment member having a bottom and a sidewall extending from a perimeter of the bottom. An end of the sidewall opposite the bottom may form an open end of the containment member, and the sidewall and bottom may form an interior of the containment member. The container apparatus may further include a flange that may extend around a perimeter of the side wall proximate the open end. A plurality of upper wall members may extend from the flange, with each upper wall member having a top face and a side face and being spaced from another upper wall member by a ventilation aperture. A sealing material (e.g., a film) may be removably mounted to the top surface of the upper wall members, extending over the open end of the containment member, so that ventilation aperture and interior remain open to the atmosphere. In further alternative embodiments, the first containment member may be connected by a hinge to a second, similarly shaped, containment member.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION OF THE EMBODIMENTS

The following detailed description is not to be taken in a limiting sense, but is made for the purpose of illustrating the general principles of the disclosed apparatus, since the scope of the present disclosure is best defined by the appended claims.

In the following description, certain terminology is used to describe certain features of one or more embodiments of the present disclosure. The term "container" refers to any type of device for holding objects, including a receptacle, a bin, a box, a carton, a case, and a crate. The term "food" refers to any type of edible substance including all types of fruits and vegetables.

Figure 1:
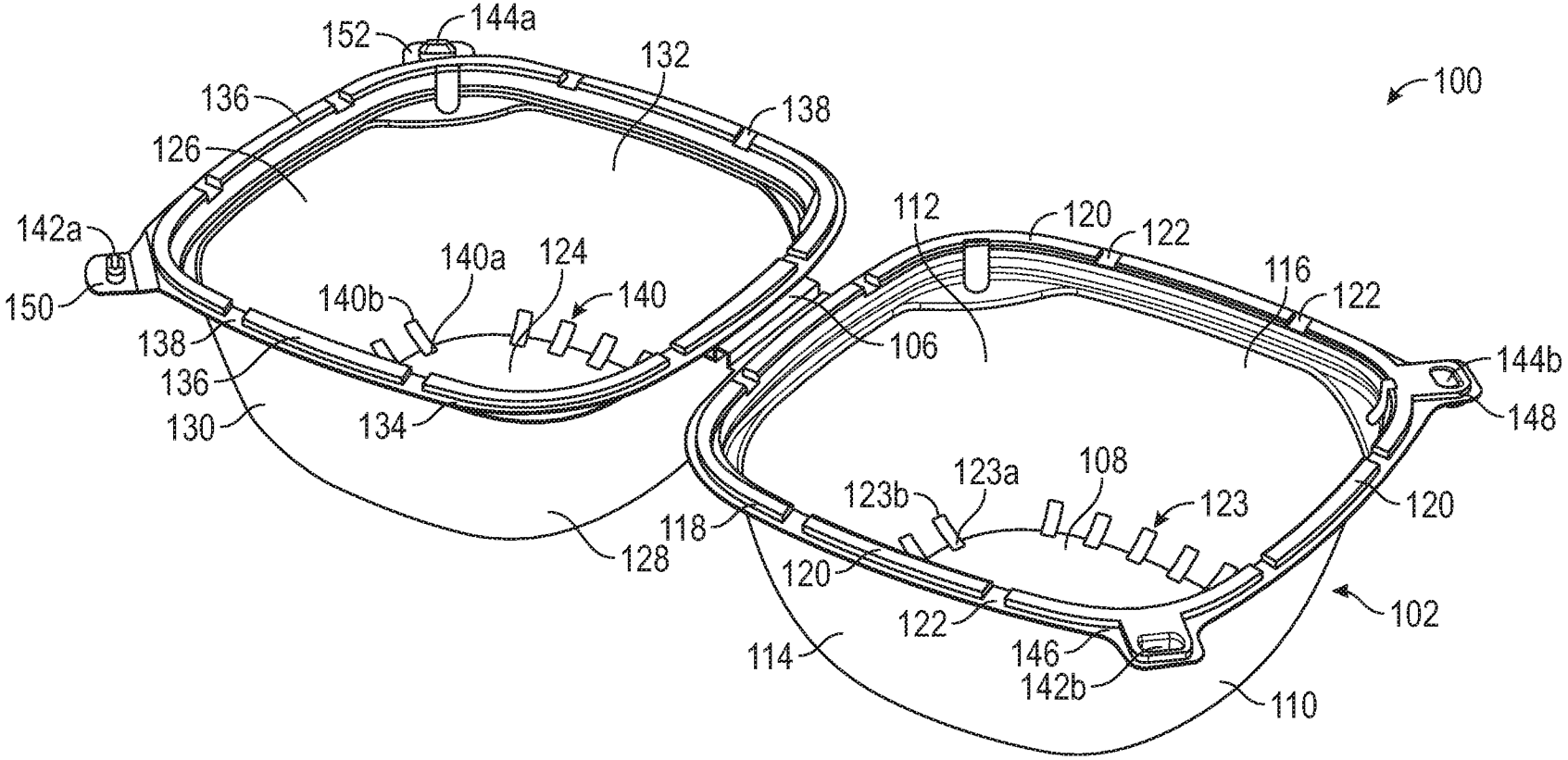
FIG. 1 illustrates a top perspective view of an unsealed container in an open configuration, according to an embodiment.
Figure 2:
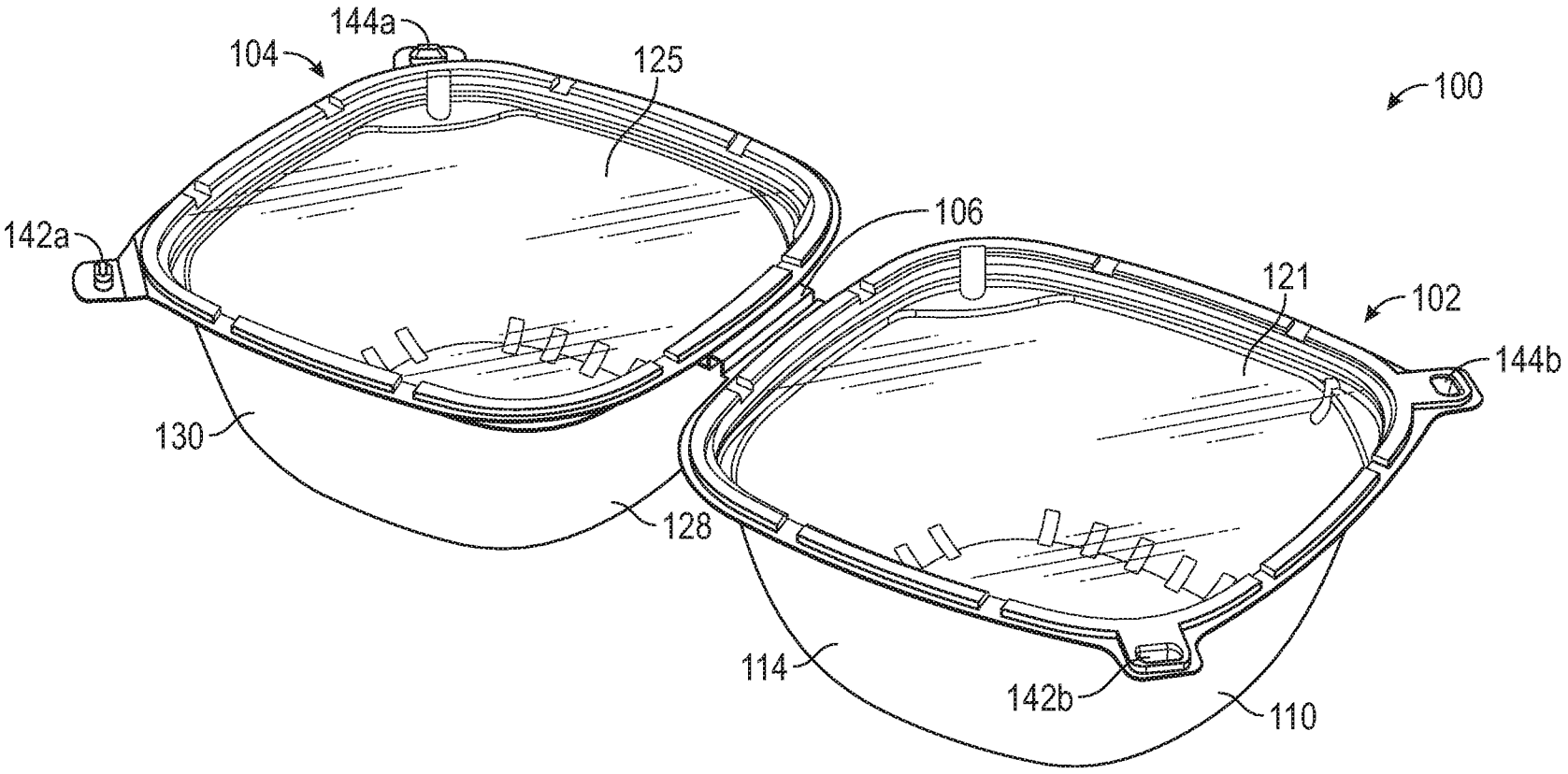
FIG. 2 illustrates the container of FIG. 1 with the first containment member and the second containment member hermetically sealed, or partially sealed, according to an embodiment.
Figure 3:
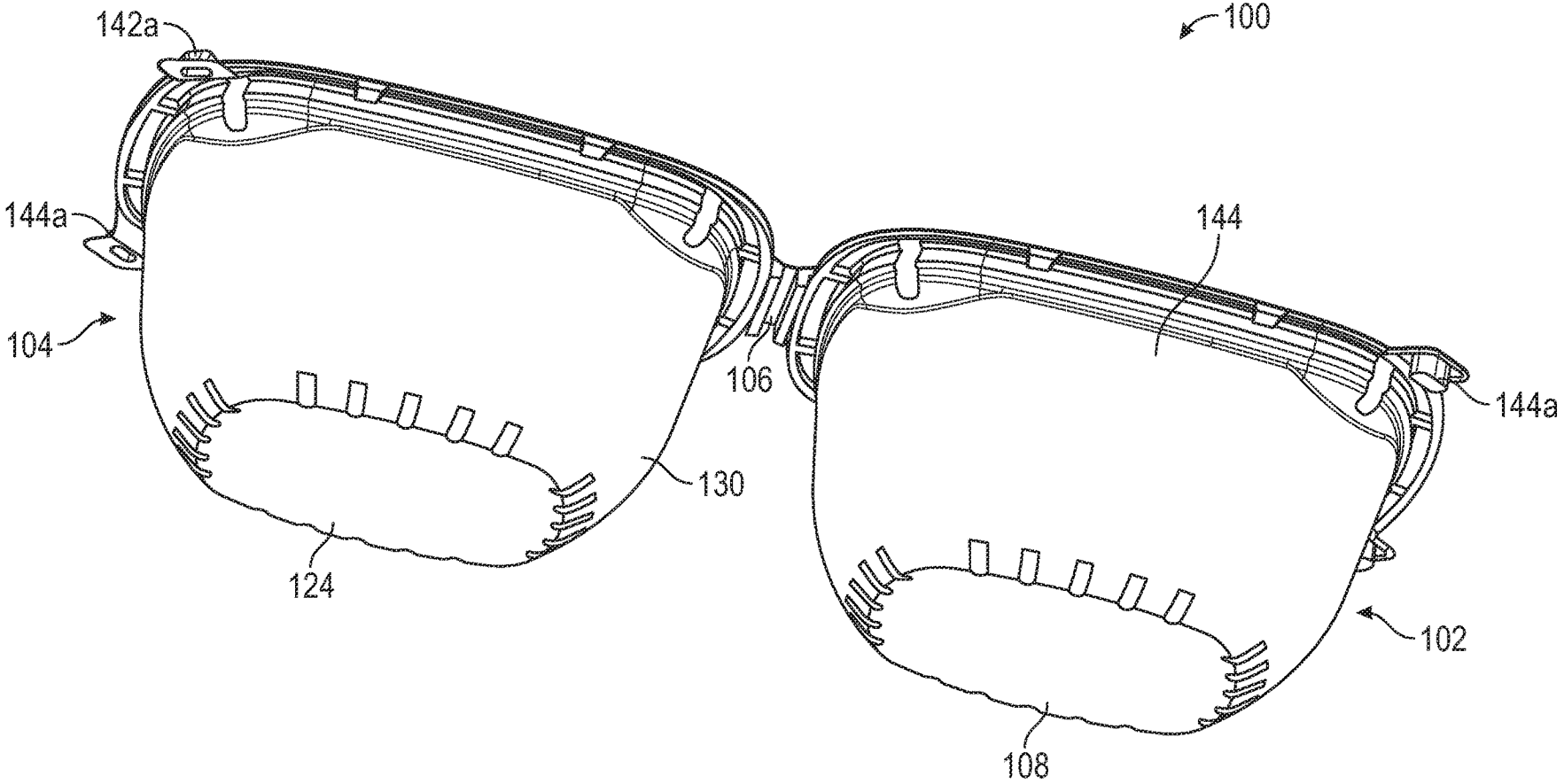
FIG. 3 illustrates a bottom perspective view of the container of FIG. 1.
Figure 4:
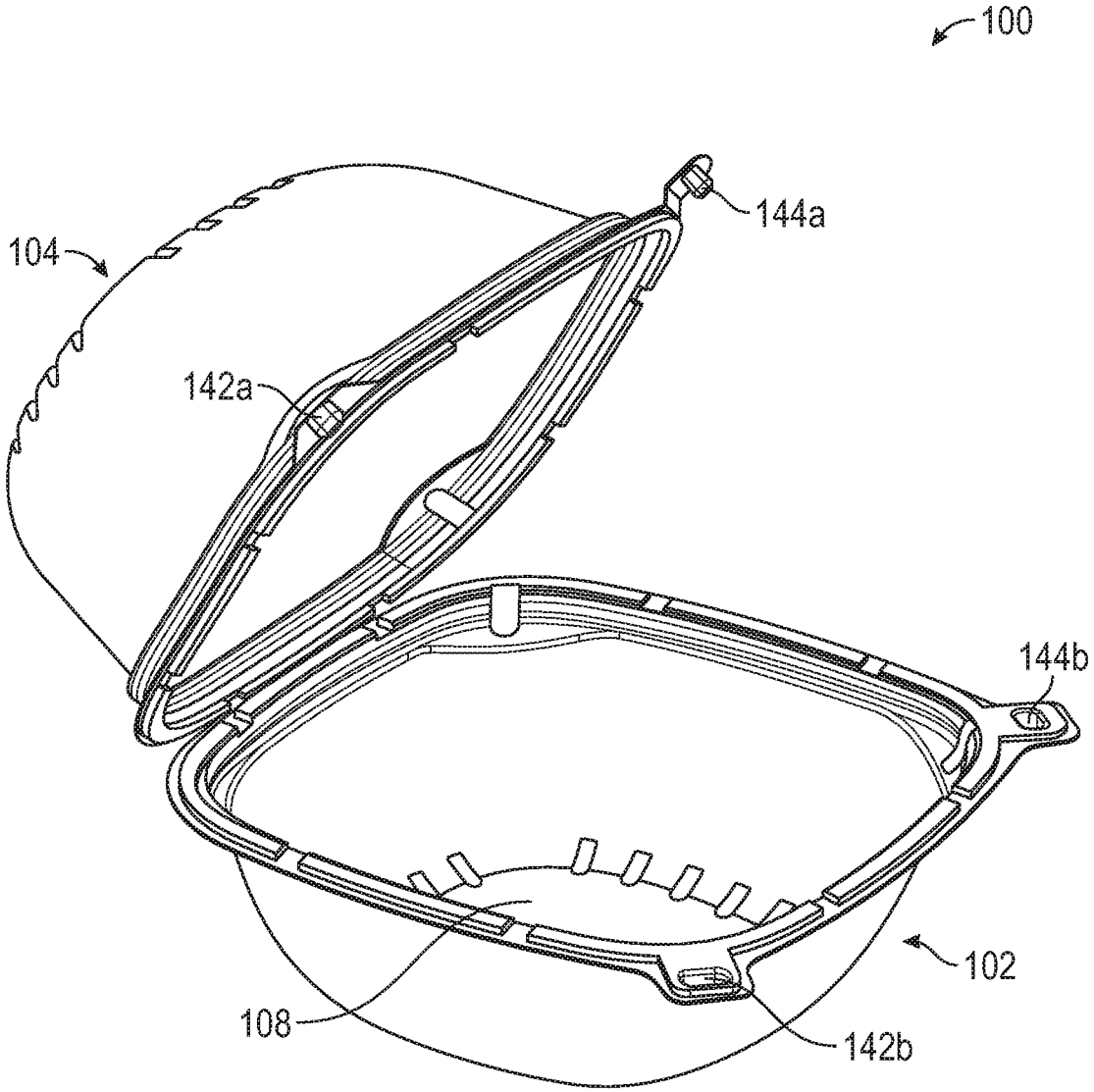
FIG. 4 illustrates a top perspective view of the container of FIG. 1 in a partially closed configuration.
Figure 5:
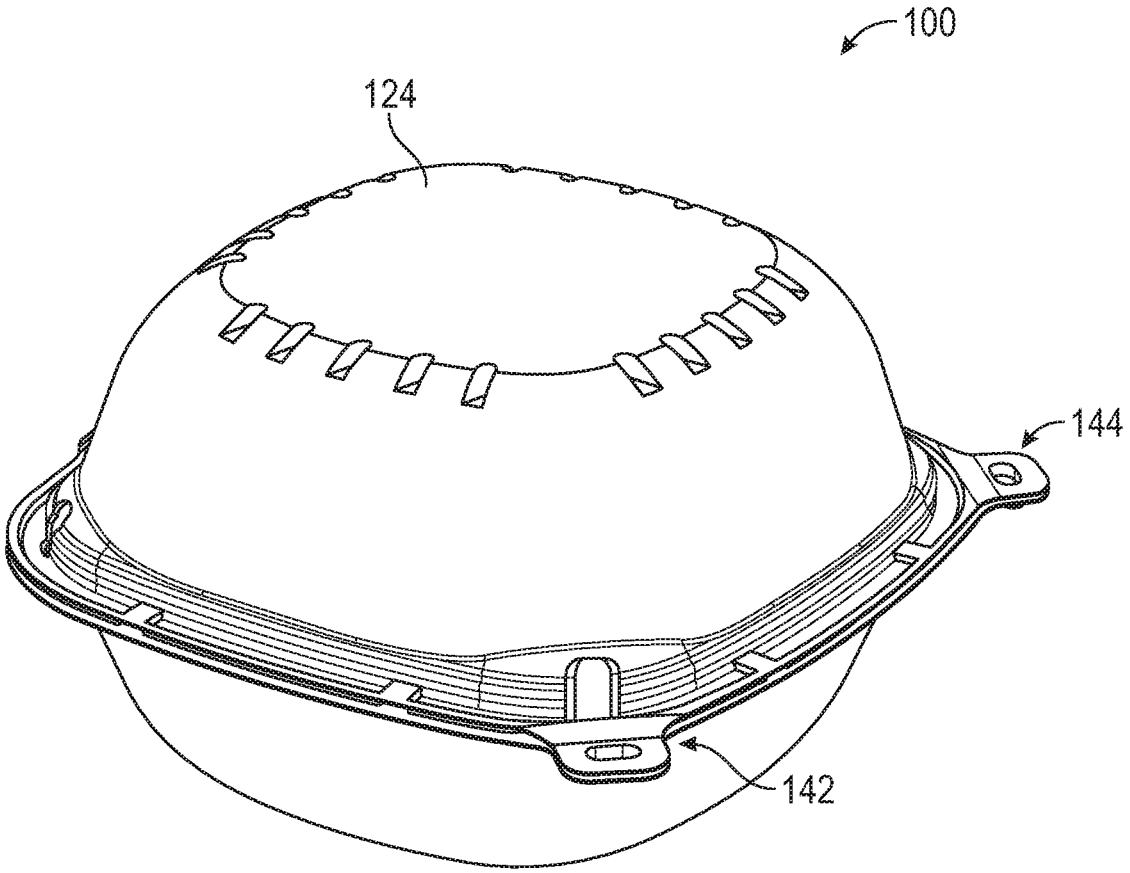
FIG. 5 illustrates a top perspective view of the container of FIG. 1 in a closed configuration.
Figure 6:
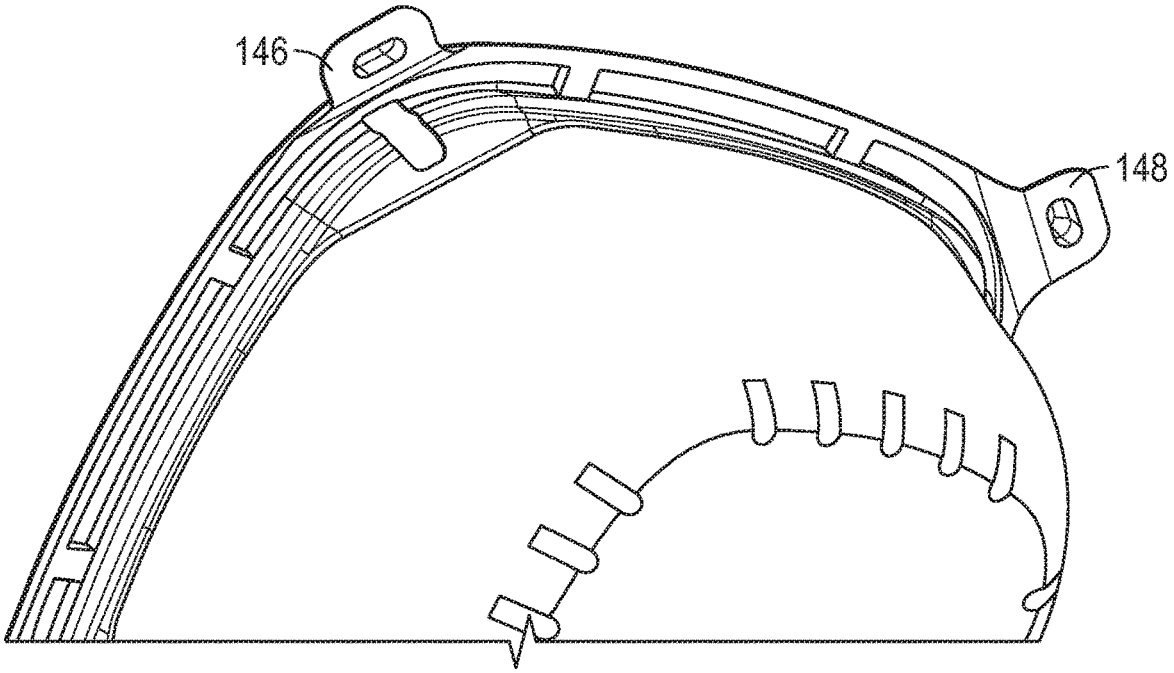
FIG. 6 illustrates a partial close up view of the first containment member of the container of FIG. 1.
Figure 7:
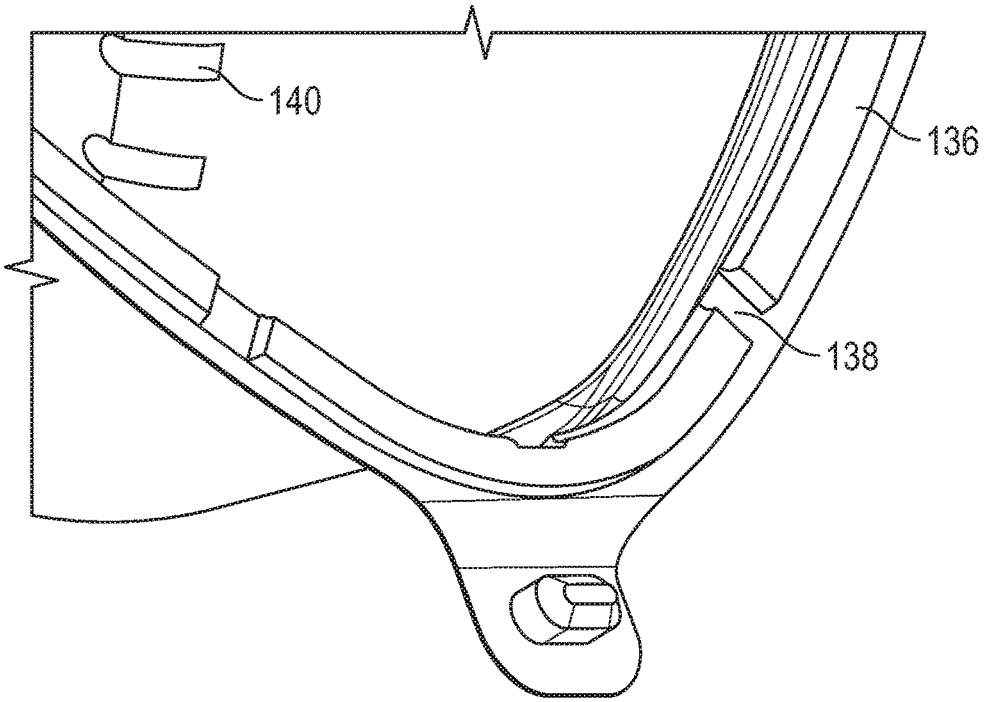
FIG. 7 illustrates a partial close up view of the second containment member of the container of FIG. 1.

FIG. 1 illustrates a perspective view of an unsealed container in an open configuration, according to an embodiment of the present disclosure. FIG. 2 illustrates the container of FIG. 1 with a first containment member and a second containment member hermetically sealed, or at least partially sealed, according to an embodiment. FIG. 3 illustrates a bottom perspective view of the container of FIG. 1. FIG. 4 illustrates a top perspective view of the container of FIG. 1 in a partially closed configuration. FIG. 5 illustrates a top perspective view of the container of FIG. 1 in a closed configuration. FIG. 6 illustrates a partial close up view of the first containment member of the container of FIG. 1. FIG. 7 illustrates a partial close up view of the second containment member of the container of FIG. 1. The following discussion refers interchangeably to FIGS. 1-7.

According to embodiments of the present disclosure, the container 100 may be made of polyethylene terephthalate (PET), polystyrenes, polypropylenes, or any other suitable material known in the art.

As shown, the container 100 may include a first containment member (or base) 102. The container 100 may, in some embodiments be a stand-alone container or, alternatively be connected to a second containment member (or second base or lid) 104 via a hinge 106. The first containment member 102 may include a floor or bottom 108 with a sidewall that extends upward from the bottom 108 to form an internal cavity for the container 100. It will be appreciated that the sidewall may take a number of predetermined forms, and include a number of predetermined sidewall surfaces. For example, in the embodiment disclosed herein, the sidewall may include two opposing lower sidewalls 110 and 112 integrally connected to two opposing lower end walls 114 and 116. The lower sidewalls, 110 and 112, and lower end walls, 114 and 116, extend continuously upwardly from the bottom 108 to form the first containment member 102.

As shown, a flange may extend outwardly from the edge of the sidewall proximate the open end of the interior cavity. It will again be appreciated that the flange may be formed in a number of different predetermined configurations. Again referring to the disclosed embodiment, the lowermost edges of the lower sidewalls 110 and 112 and the lower end walls 114 and 116 define a perimeter of the first containment member 102 by which a lower flange 118 may be integrally connected thereto.

As shown, a flange of the container 100 may also include castellations, or a plurality of wall members (the wall members may hereinafter be referred to as upper wall members, lower wall members or wall members (where there is a singular containment member)) that may extend with the flange around the perimeter of the flange/open end (hereinafter referred to as an upper flange, lower flange or flange (where there is a singular containment member)). The castellations or wall members may be separated from one another by ventilation apertures 122. The first plurality of ventilation apertures (lower ventilation apertures 122, upper ventilation apertures 136 or ventilation aperture (where there is a singular containment member)) allow moisture to escape the containment member and allow air to flow when the sealing material is placed over the opening to the containment member. In other embodiments, the sealing material is connected directly to the flange adjacent to the wall members, positioned to contact the upper surface of the wall members to provide for ventilation, positioned to extend over the wall members or positioned to extend over the ventilation members to connect to the sidewalls (or otherwise). A second plurality of lower ventilation apertures 123 may be located in the first containment member 102 for allowing air to flow through the first containment member 102. According to one embodiment, each of the second plurality of lower ventilation apertures 123 has a first end 123*a* and a second end 123*b*, where the first end 123*a* is located at an outer edge of the bottom 108 and extend at least partially up the lower sidewalls, 110 and 112, and lower end walls, 114 and 116 terminating at the second end 123*b*. Although the second plurality of lower ventilation apertures 123 are shown having a generally rectangular shape, this is by way of example only and may be ovals, triangles, squares, or other polygons.

As shown in FIGS. 1 and 2, sealing material (or film) 121 may be placed over the plurality of lower wall members 120 to cover the opening to the first containment member 102. The sealing material (or film) 121 may be removable by a user of the container 100. Additionally, or alternatively, the sealing material (or film) 121 may include an adhesive that permits the sealing material (or film) 121 may be detached and reattached to the container 100. The embodiment of the first containment member 102 as illustrated in FIG. 2 may be a stand-alone container, or be connected to the second containment member 104 (such as depicted). It should be appreciated that each of the first containment member 102 and the second containment member 104 may be stand-alone members without a hinge where the film 121 acts as a lid to secure the contents contained within either the first containment member 102 or the second containment member 104.

Alternatively, the first containment member 102 may be solid and not include first plurality of lower ventilation apertures 122 and/or the second plurality of lower ventilation apertures 123. In such a case, the lower wall member 120 is one single wall member. When the first containment member 102 does not include any ventilation apertures, placing the sealing material (or film) 121 over the opening cavity or on the lower wall member 120, hermetically seals in the contents of the first containment member 102.

The second containment member 104 may include a top 124 and two opposing upper sidewalls 126 and 128 integrally connected to two opposing upper end walls 130 and 132. The upper sidewalls, 126 and 128, and upper end walls, 130 and 132, extend continuously downward from the top 124 to form the second containment member 104. The lowermost edges of the upper sidewalls 126 and 128 and the upper end walls 130 and 132 define a perimeter of the second containment member 104 by which an upper flange 134 may be integrally connected thereto. A plurality of upper wall members 136, separated by a first plurality of upper ventilation apertures 138, may extend around the perimeter of the upper flange 134 (e.g., around the open end).

With reference to FIGS. 1 and 2, a sealing material (or film) 125 may be placed over the plurality of upper wall members 136 covering the opening to the second containment member 104 hermetically sealing in the contents of the second containment member 104.

The first plurality of upper ventilation apertures 138 allow moisture to escape the second containment member 104 and allow air to flow when the sealing material is placed over the opening to the second containment member 104. A second plurality of upper ventilation apertures 140 may be located in the second containment member 104 for allowing air to flow through the second containment member 104. According to one embodiment, each of the second plurality of upper ventilation apertures 140 has a first end 140*a* and a second end 140*b*, where the first end 140*a* is located at an outer edge of the top 124 and extend at least partially up the upper sidewalls, 126 and 128, and upper end walls, 130 and 132 terminating at the second end 140*b*. Although the second plurality of upper ventilation apertures 140 are shown having a generally rectangular shape, this is by way of example only and may be ovals, triangles, squares, or other polygons.

Alternatively, the second containment member 104 may be solid and not include first plurality of upper ventilation apertures 138 and/or the second plurality of upper ventilation apertures 140. In such a case, the upper wall member 136 is one single wall member. When the second containment member 104 does not include any ventilation apertures, placing the sealing material (or film) 125 over the opening cavity or on the upper wall member 136, hermetically seals in the contents of the second containment member 104.

The container 100 may also include a pair of locking mechanisms 142 and 144 to secure the second containment member 104 to the first containment member 102 and prevent consumers from prematurely or easily opening the container 100 prior to sale, as well as preventing the second containment member 104 from separating from the first containment member 102 during transportation and spilling and/or damaging its contents. The pair of locking mechanisms may include extending latching portions 142*a* and 144*a* which may be received by inwardly recessed pockets 142*b* and 144*b*. When engaged, the extending latching portions 142*a* and 144*a* and inwardly recessed pockets 142*b* and 144*b* snap together, securely holding the second containment member 104 and first containment member 102 of the container 100 together. Although two locking mechanisms 142 and 144 are shown, the container 100 may have only one locking mechanism or may have more than two locking mechanisms. Alternatively, any other locking mechanism known in the art may be used.

According to one embodiment, a pair of lower tabs 146, 148 may extend perpendicular outward from the lower flange 118 where the lower sidewall 110 and the lower end walls 114, 116 are formed together. The first inwardly recessed pocket 142*b* may be located in the first lower tab 146 and the second inwardly recessed pocket 144*b* may be located in the second lower tab 148.

According to one embodiment, a pair of upper tabs 150, 152 may extend perpendicular outward from the upper flange 124 where the upper sidewall 126 and the upper end walls 130, 132 are formed together. The first extending latching portion 142*a* may be located in the first upper tab 150 and the second extending latching portion 144*a* may be located in the second upper tab 152.

The pair of lower tabs 146, 148 and the pair of upper tabs extending latching portion 142*a* may be used to assist an individual in separating the second containment member 104 from the first containment member 102 when the container 100 is in a closed configuration.

One or more of the components and functions illustrated in the previous figures may be rearranged and/or combined into a single component or embodied in several components without departing from the present disclosure. Additional elements or components may also be added without departing from the present disclosure.

While certain exemplary embodiments have been described and shown in the accompanying drawings, it is to be understood that such embodiments are merely illustrative of and not restrictive on the broad present disclosure, and that this present disclosure is not be limited to the specific constructions and arrangements shown and described, since various other modifications may occur to those ordinarily skilled in the art.

We claim:

1. A container apparatus comprising:

a containment member having a bottom, a sidewall, and at least one aperture formed in at least one of the bottom and the sidewall, the bottom and the sidewall being integrally connected to form an internal cavity, the sidewall having a free end opposite the bottom, the free end defining an open end for the containment member;

a flange integrally connected to the free end of the sidewall;

a plurality of wall members extending from the flange, each of the plurality of wall members being separated by a ventilation aperture, the plurality of wall members and the ventilation apertures extending around the open end;

a film connected to the plurality of wall members;

a second containment member hingedly connected to the containment member, the second containment member having a bottom and a sidewall, the bottom and the sidewall of the second containment member being integrally connected to form an internal cavity of the second containment member, and the sidewall of the second containment member having a free end opposite the bottom, the free end of the second containment member defining an open end for the second containment member; and a second film connected to the second containment member to cover the open end of the second containment member.

2. The container apparatus of claim 1, wherein the film covers the open end of the containment member so that the ventilation apertures and the internal cavity remain open to an atmosphere.

3. The container apparatus of claim 1, wherein each of the plurality of wall members includes a top surface, and wherein the film is mounted to the top surfaces of the plurality of wall members so that the ventilation apertures and the internal cavity remain open to an atmosphere.

4. The container apparatus of claim 1, wherein the ventilation apertures allow moisture to escape the containment member and allow air to flow when the film is mounted to the top surface of the plurality of wall members.

5. The container apparatus of claim 1, wherein the film is connected to the plurality of wall members to substantially cover the open end such that the ventilation apertures allow air to flow into the containment member.

6. The container apparatus of claim 1, wherein each of the plurality of wall members includes a pair of side faces, and wherein the ventilation apertures are positioned between side faces of adjacent wall members.

7. The container apparatus of claim 1, wherein the film is removably mounted to the top surfaces of the plurality of wall members.

8. The container apparatus of claim 7, wherein each of the plurality of wall members includes a pair of side faces, and wherein the ventilation apertures are positioned between side faces of adjacent wall members.

9. The container apparatus of claim 7, wherein each of the plurality of wall members includes a top surface, and wherein the film is mounted to the top surfaces of the plurality of wall members so that the ventilation apertures and the internal cavity remain open to an atmosphere.

10. The container apparatus of claim 7, wherein the ventilation apertures allow moisture to escape the containment member and allow air to flow when the film is mounted to the top surface of the plurality of wall members.

11. A container apparatus comprising:

a containment member having a bottom, at least one sidewall, and at least one aperture formed in at least one of the bottom and the at least one sidewall, the bottom and the at least one sidewall being integrally connected to form an internal cavity, the at least one sidewall having an edge opposite the bottom, the edge defining an open end of the containment member;

a flange extending outwardly from the edge of the at least one side wall;

a plurality of wall members extending from the flange, each of the plurality of wall members being separated by a ventilation aperture, the plurality of wall members and the ventilation apertures extending around a perimeter of the open end;

a film connected to the plurality of wall members, the film extends over the open end of the containment member so that the ventilation apertures and the internal cavity remain open to an atmosphere;

a second containment member hingedly connected to the containment member, the second containment member having a bottom and at least one sidewall, the bottom and the at least one sidewall of the second containment member being integrally connected to form an internal cavity, and the at least one sidewall of the second containment member having an edge opposite the bottom, the edge of the second containment member defining an open end for the second containment member; and a second film connected to the second containment member, the second film extends over the open end of the second containment member.

12. The container apparatus of claim 11, wherein each of the plurality of wall members includes a top surface, and wherein the film is mounted to the top surfaces of the plurality of wall members so that the ventilation apertures and the internal cavity remain open to an atmosphere.

13. The container apparatus of claim 12, wherein each of the plurality of wall members includes a pair of side faces, and wherein the ventilation apertures are positioned between side faces of adjacent wall members.

14. The container apparatus of claim 11, wherein the ventilation apertures allow moisture to escape the containment member and allow air to flow when the film is mounted to the top surface of the plurality of wall members.

15. The container apparatus of claim 11, wherein the film is connected to the plurality of wall members to substantially cover the open end such that the ventilation apertures allow air to flow into the containment member.

16. The container apparatus of claim 11, wherein each of the plurality of wall members includes a pair of side faces, and wherein the ventilation apertures are positioned between side faces of adjacent wall members.

17. The container apparatus of claim 11, wherein the film is removably mounted to the top surfaces of the plurality of wall members.

18. The container apparatus of claim 17, wherein each of the plurality of wall members includes a pair of side faces, and wherein the ventilation apertures are positioned between side faces of adjacent wall members.

19. The container apparatus of claim 17, wherein each of the plurality of wall members includes a top surface, and wherein the film is mounted to the top surfaces of the plurality of wall members so that the ventilation apertures and the internal cavity remain open to an atmosphere.

20. The container apparatus of claim 17, wherein the ventilation apertures allow moisture to escape the containment member and allow air to flow when the film is mounted to the top surface of the plurality of wall members.

* * * * *